US010669864B2

(12) United States Patent
Iurisci et al.

(10) Patent No.: US 10,669,864 B2
(45) Date of Patent: Jun. 2, 2020

(54) UNSHROUDED TURBOMACHINE IMPELLER WITH IMPROVED RIGIDITY

(71) Applicant: Nuovo Pignone Tecnologie SRL, Florence (IT)

(72) Inventors: Giuseppe Iurisci, Florence (IT); Angelo Grimaldi, Florence (IT); Simone Corbo, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 19 days.

(21) Appl. No.: 15/745,212

(22) PCT Filed: Jul. 18, 2016

(86) PCT No.: PCT/EP2016/067028
§ 371 (c)(1),
(2) Date: Jan. 16, 2018

(87) PCT Pub. No.: WO2017/013053
PCT Pub. Date: Jan. 26, 2017

(65) Prior Publication Data

US 2019/0017393 A1 Jan. 17, 2019

(30) Foreign Application Priority Data

Jul. 20, 2015 (IT) ..... 102015000036045

(51) Int. Cl.
*F01D 5/24* (2006.01)
*F01D 5/16* (2006.01)
*F01D 5/22* (2006.01)

(52) U.S. Cl.
CPC ..... *F01D 5/24* (2013.01); *F01D 5/16* (2013.01); *F01D 5/22* (2013.01)

(58) Field of Classification Search
CPC ..... F01D 5/16; F01D 5/22; F01D 5/24; F04D 17/08; F04D 17/10; F04D 17/12; F04D 29/185; F04D 29/2211; F04D 29/2216
(Continued)

(56) References Cited

U.S. PATENT DOCUMENTS 1,061,648 A * 5/1913 Westinghouse ..... F01D 5/24 416/191
3,527,546 A * 9/1970 Zeman ..... F01D 5/22 416/190

(Continued)

FOREIGN PATENT DOCUMENTS

DE 818 806 C 10/1951
DE 1163 605 B 2/1964

(Continued)

OTHER PUBLICATIONS

Italian Search Report and Written Opinion issued in connection with corresponding IT Application No. 102015000036045 dated Mar. 9, 2016.

(Continued)

*Primary Examiner* — Aaron R Eastman
(74) *Attorney, Agent, or Firm* — Baker Hughes Patent Organization

(57) ABSTRACT

An unshrouded turbomachine impeller is disclosed. The impeller comprises a hub and a plurality of sequentially arranged blades. Each blade extends from a blade root at the hub to a blade tip and is comprised of a first blade edge and a second blade edge. A flow vane is formed between each pair of neighboring blades. A connection member extends across each flow vane between neighboring blades and rigidly or monolithically connects a first modal displacement (Continued)

region of a first one of the pair of neighboring blades to a second modal displacement region of a second one of the pair of neighboring blades.

11 Claims, 5 Drawing Sheets

(58) Field of Classification Search
USPC ..... 416/196 R, 179, 180, 182
See application file for complete search history.

(56) References Cited

U.S. PATENT DOCUMENTS

| | | | | |
|---|---|---|---|---|
| 4,191,508 | A * | 3/1980 | Kuroda | F01D 5/24 416/190 |
| 4,820,115 | A | 4/1989 | Bandukwalla | |
| 5,984,638 | A | 11/1999 | Gresh et al. | |
| 2004/0191068 | A1* | 9/2004 | Richter | F01D 5/24 416/223 R |
| 2014/0294582 | A1* | 10/2014 | Fujioka | F04D 25/02 415/228 |

FOREIGN PATENT DOCUMENTS

| | | | |
|---|---|---|---|
| EP | 0 385 833 | A1 | 9/1990 |
| GB | 255878 | A | 10/1926 |
| GB | 696557 | A | 9/1953 |

OTHER PUBLICATIONS

International Search Report and Written Opinion issued in connection with corresponding PCT Application No. PCT/EP2016/067028 dated Nov. 16, 2016.
International Preliminary Report on Patentability issued in connection with corresponding PCT Application No. PCT/EP2016/067028 dated Jan. 23, 2018.

* cited by examiner

UNSHROUDED TURBOMACHINE IMPELLER WITH IMPROVED RIGIDITY

BACKGROUND OF THE INVENTION

The disclosure in general relates to turbomachines and impellers thereof. Embodiments disclosed herein refer to so-called unshrouded impellers.

Radial or mixed turbomachines usually comprise one or more impellers arranged for rotation in a casing. Each impeller is comprised of a hub and a plurality of blades. The blades extend from a blade root, at the front surface of the hub, to a blade tip.

Shrouded impellers are known, wherein blades are arranged between the hub and an outer shroud surrounding the hub and rotating therewith. Closed flow vanes between the shroud, the hub and neighboring impellers are thus defined. The shroud improves the stiffness of the impeller blades.

Some turbomachines use unshrouded impellers, wherein the blades extend from the hub and end at respective free blade tips. The flow vanes are in this case defined between the hub, pairs of neighboring blades and a stationary surface of the casing.

As other mechanical components, rotating turbomachine impellers are subject to resonance phenomena. When a turbomachine impeller rotates at a rotational speed proximate a resonance frequency, the blades of the impeller can experience modal displacements, which induce machine vibrations and fatigue stress, eventually resulting in turbomachine failure. Different parts of a machine or machine component can be subject to different modal displacements at the same frequency, i.e. different areas of the machine or machine component undergo different displacements when the machine or component is subject to vibration at a given resonance frequency.

While shrouded impellers are less subject to dynamic stresses resulting from resonance phenomena, unshrouded impellers are more subject to deformations when operating near a resonance frequency. In particular, in case of large flow coefficients, controlling the aeromechanical behavior of impellers becomes difficult. The first flexural mode frequency of this kind of impellers is relatively low and may be easily excited under normal operating conditions of the turbomachine.

In order to at least partly alleviate the above problem, tapered blades are often used, i.e. blades the thickness whereof reduces from the blade root towards the blade tip. This approach, however, is unsatisfactory, because the first flexural natural frequency of the blade cannot be increased enough to move sufficiently away the vibration mode from the impeller operating range.

Therefore, there is still a need of improving radial or mixed-flow turbomachines using unshrouded impellers, in order to reduce the above mentioned drawbacks connected to resonance frequencies.

SUMMARY OF THE INVENTION

In one aspect, an unshrouded turbomachine impeller is provided. The impeller comprises a hub, or disk, and a plurality of sequentially arranged blades, each blade extending from a blade root at the hub to a blade tip and comprised of a first blade edge and a second blade edge. The first blade edge and the second blade edge extend from the hub to the blade tip. The second blade edge can be located more distant from a rotation axis of the impeller than the first blade edge.

A flow vane between each pair of neighboring blades is formed. Moreover, a connection member is provided across each flow vane between pairs of neighboring blades, to connect a region having a first modal displacement of a first one of the neighboring blades, to a region having a second modal displacement of a second one of said neighboring blades. The first modal displacement is larger than the second modal displacement.

The blades of the impeller are thus made stiffer and displacement modes are moved away from the impeller operation condition.

In another aspect a turbomachine is provided. The turbomachine comprises a casing and at least one turbomachine impeller as above defined, mounted for rotation in the casing.

In a yet further aspect, a method for producing a turbomachine impeller is disclosed, comprising the steps of:

manufacturing an impeller body comprised of a hub and a plurality of sequentially arranged blades, extending from a front surface of the hub to respective blade tips, and defining a plurality of flow vanes between pairs of neighboring blades;

arranging in each flow vane a connection member having a first end and a second end, the first end rigidly or monolithically connected to a first one of the pair of neighboring blades, and the second end rigidly or monolithically connected to a second one of said pair of neighboring blades.

The connection member can be rigidly or monolithically connected to the respective blade by means of any suitable process, such as brazing, soldering, welding, gluing or the like. These processes allow to generate a rigid and firm connection which is not reversible. The connection member needs to be rigidly or monolithically connected to the blades in order to avoid its disconnections during the operation of the compressor. Using the above cited processes, connection holes on the blades can be avoided for connecting the connection member. These holes could represent points of high concentration of mechanical stresses during the operation of the compressor, causing failures of the impeller. A further method of manufacturing a turbomachine impeller according to the present disclosure is also provided, which comprises the step of machining the hub, the blades and the connection members by full milling from a single piece or blank. In this way a monolithic connection of the connection member with respective blades can be achieved.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
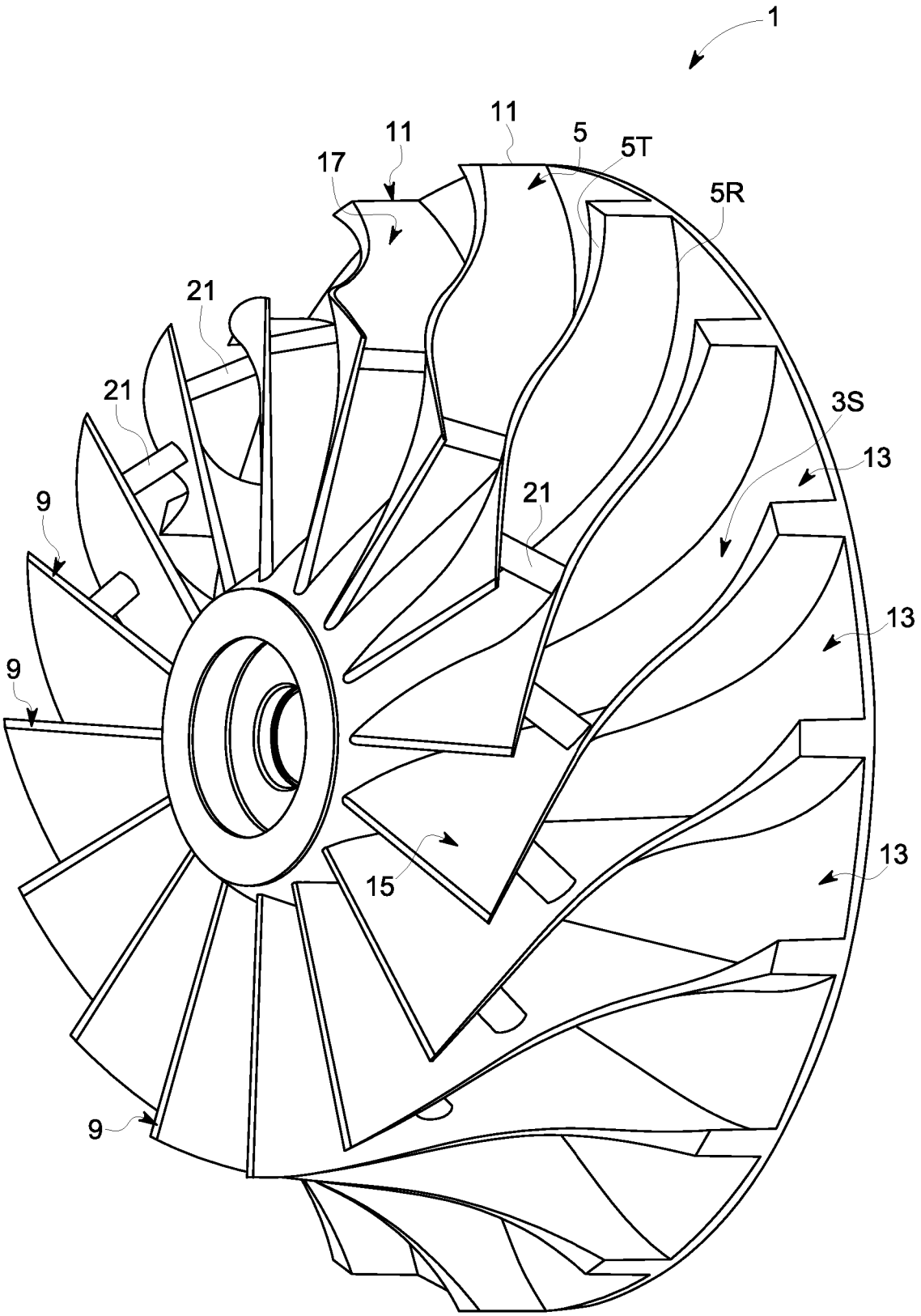
FIG. 1 illustrates an axonometric view of an exemplary unshrouded radial compressor impeller, according to the present disclosure.
Figure 2:
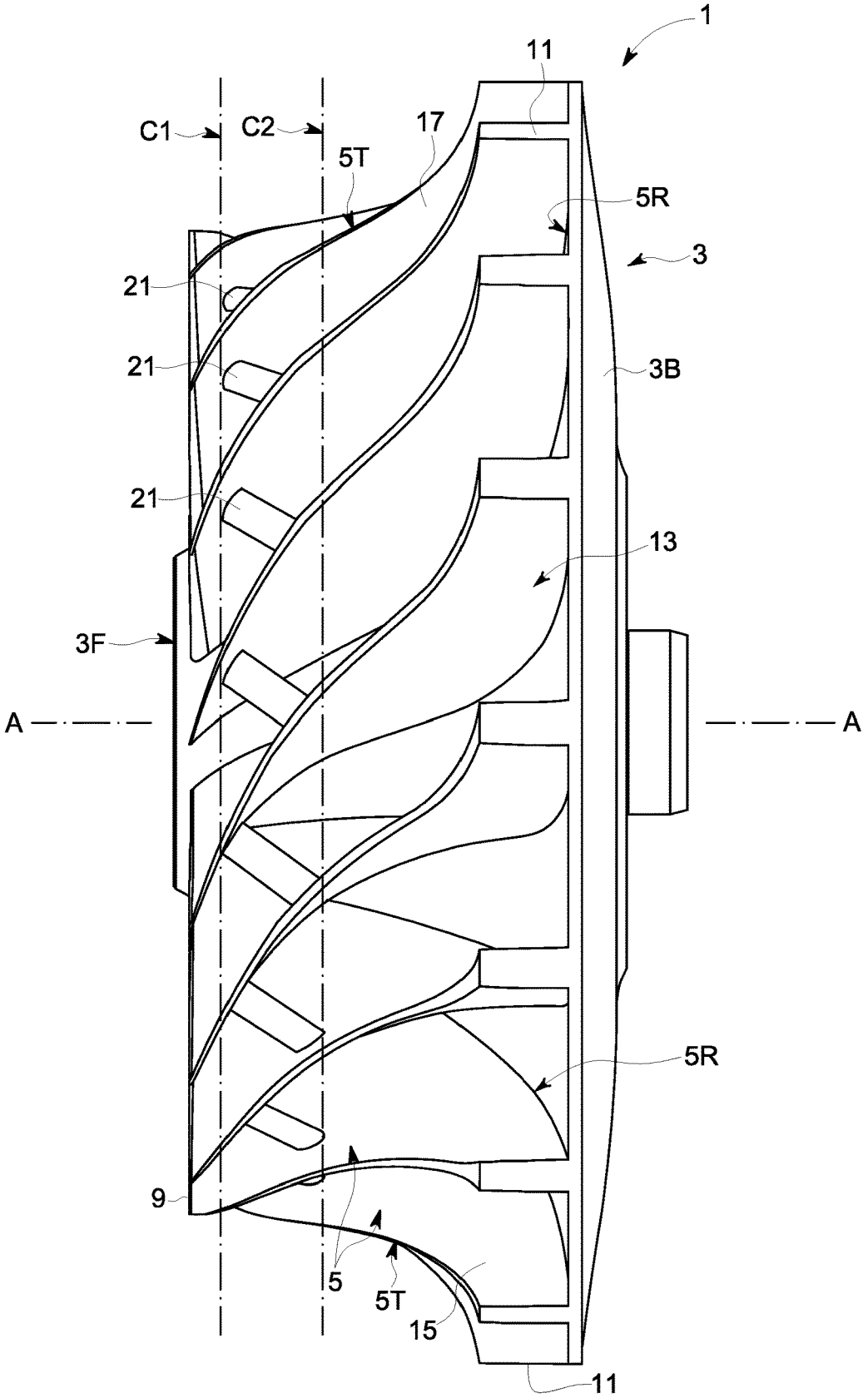
FIG. 2 illustrates a side view of the impeller of FIG. 1.

FIGS. 1 and 2 illustrate an exemplary unshrouded impeller for a radial turbomachine, e.g. a centrifugal compressor. The impeller 1 is comprised of a hub 3, also referred to as disk, having a back surface 3B and a front surface 3F, as well as a side surface 3S therebetween. The impeller 1 has a rotation axis A-A and a plurality of blades 5 developing from a side surface 3S of the hub 3. In the exemplary embodiment of FIGS. 1 and 2 all the blades 5 are substantially identical to one another. In other embodiments, an additional set of shorter blades can be provided, e.g. between each pair of neighboring main blades 5. Also, additional substantially axial blades can be arranged at the impeller inlet.

Each blade 5 extends from a blade root 5R, located at the hub 3, to a blade tip 5T. Moreover, each blade comprises two blade edges 9 and 11. Just for the sake of clarity, herein after the blade edge 9, which is located nearer to the impeller rotation axis A-A, will be referred to as the "first blade edge" and the blade edge 11, which is located at a greater radial distance from the impeller rotation axis A-A, will be referred to as the "second blade edge". A flow vane 13 is formed between each pair of consecutive, i.e. neighboring blades 5 and the side surface 3S of the hub 3. Since the impeller 1 of FIGS. 1 and 2 is a centrifugal compressor impeller, the first blade edge 9 is the leading edge of the blade and the second blade edge 11 is the trailing edge of the blade, as the fluid flows in a centrifugal direction from the impeller inlet, located at the first blade edges 9, towards the impeller outlet, located at the second blade edges. In a centripetal turbomachine, e.g. a turboexpander or a radial turbine, the second blade edge 11 is the leading edge and the first blade edge 9 is be the trailing edge, the fluid flow being oriented in a radial centripetal direction, the impeller inlet being located at the second blade edges 11 and the impeller outlet being located at the first blade edges 9.

Each blade 5 has opposing side surfaces extending from the first blade edge 9 to the second blade edge 11 and from the blade root 5R to the blade tip 5T. One of said side surfaces defines a suction side 15 of the blade 5 and the other side surface defines a pressure side 17 of the blade.

When the impeller is mounted on a shaft of the turbomachine and rotates at a rotational speed approaching one of the resonance frequencies of the blades 5, these latter will start vibrating. The vibration mode and thus the displacement performed by the various parts of the blade depend upon the vibration frequency. Regions of different modal displacements, i.e. which experience different displacements when the impeller is subject to resonance phenomena, can be found on the blades. More specifically, at least a region having a first modal displacement and a region having a second modal displacement can be located on the blade. Herein after these regions are also referred to as first modal displacement region and second modal displacement region, respectively.

The location of these regions can depend upon the blade structure and upon the resonance frequency. For instance, a region having a second modal displacement can be a region where the modal displacement at a certain natural vibration mode, thus at a certain frequency (i.e. at a given resonance frequency) is smaller compared to the modal displacement of a region having a first modal displacement at the same frequency. A region having a second modal displacement can also include a node of the blade for a given resonance frequency, i.e. a region where the modal displacement is zero.

Figure 3:
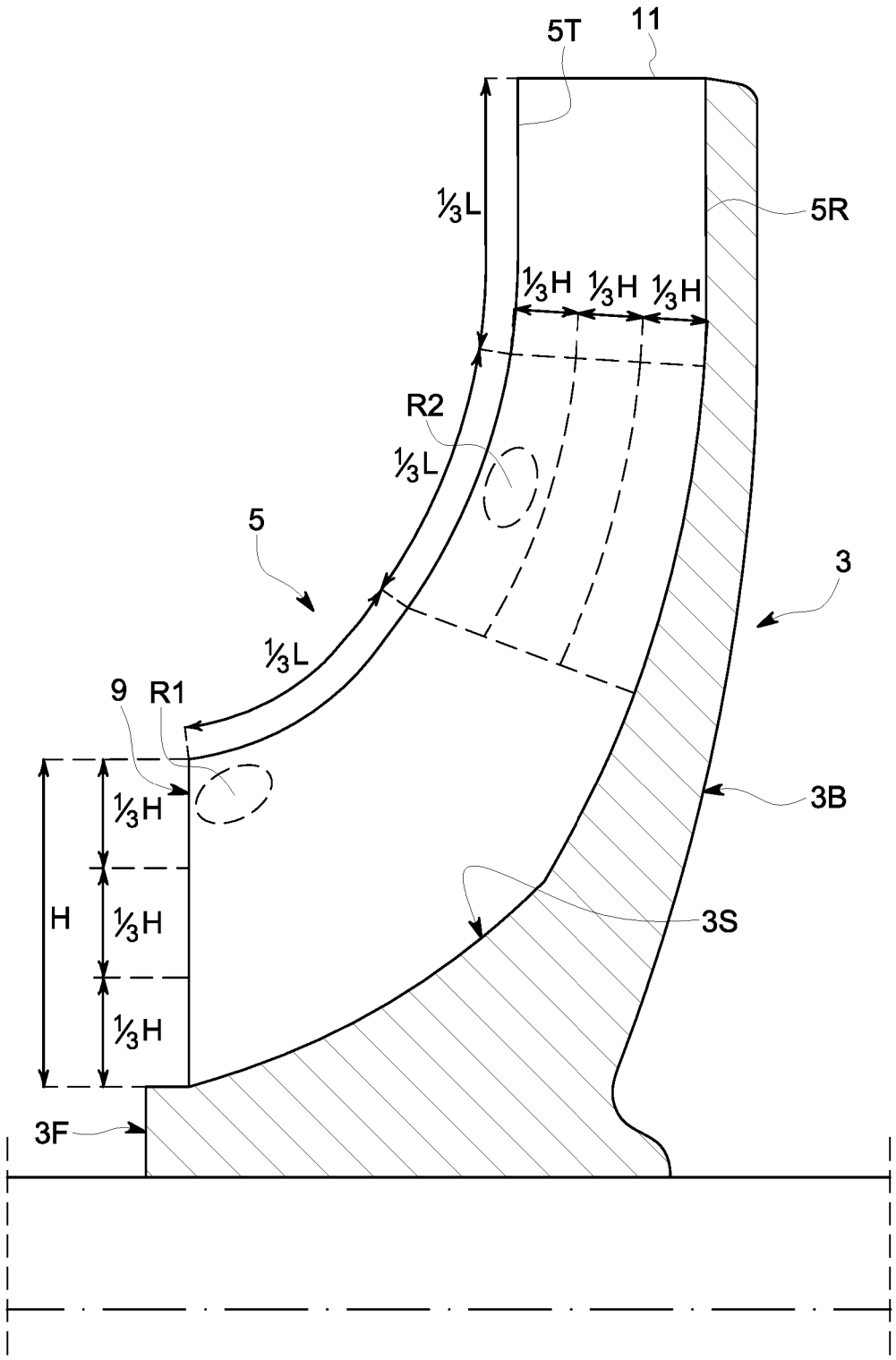
FIG. 3 illustrates a schematic side view of a blade of the impeller of FIGS. 1 and 2, showing a region having a first modal displacement and a region having a second modal displacement.

Usually, the blade region adjacent or near the blade tip 5T and the first blade edge 9 is a first modal displacement region. At least at the lower resonance frequencies, and more specifically the first blade flexural and torsional modes that are the most dangerous ones, due to the lower frequencies and higher response, the modal displacement of intermediate regions of the blade, between the first blade edge 9 and the second blade edge 11 are second modal displacement regions, i.e. regions where the blade displacement caused by the resonant vibration of the blade is smaller than at the tip region near the first blade edge 9. In FIG. 3 two regions R1 and R2 are schematically represented. The region R1 broadly represents a region having a first (larger) modal displacement, i.e. a first modal displacement region, and the region R2 broadly represents a region having a second (smaller) modal displacement, i.e. a second modal displacement region of the blade 5.

In the embodiment shown in FIG. 3, the first modal displacement region R1, which is characterized by the first modal displacement, is located near the first blade edge 9 and more specifically within the first third of the blade extension, starting from the first blade edge 9, i.e. within a distance of L/3 from the first blade edge 9, L being the length of the blade at the tip.

Moreover, the first modal displacement region R1 is located in the last third of the total blade height H, i.e. at a distance between 2H/3 and H from the blade root 5R.

The second modal displacement region R2 is usually located at a distance from both the first blade edge 9 and the second blade edge 11, typically at a distance between L/3 and 2L/3 from the first blade edge 9 and intermediate the blade root 5R and the blade tip 5T, e.g. between and 2H/3 and H from the blade root 5R as schematically shown in FIG. 3. Also the rest of the blade is usually interested by lower modal displacements than the first modal displacement region R1.

In order to reduce the modal displacement at the first modal displacement region R1 of the blades 5, and thus in order to make the blades 5 stiffer, according to an important aspect disclosed herein, the first modal displacement region R1 of a first one of a pair of neighboring blades 5, defining a flow vane 13 therebetween, is connected to a second modal displacement region R2 of a second one of said pair of neighboring blades 5.

The linkage or connection between the first modal displacement region R1 and the second modal displacement region R2 of each pair of neighboring blades 5 can be provided by a connection member 21. In an embodiment, a stiffening connection member 21 is provided in each flow vane 13.

Each connection member 21 can be comprised of a strut or a tie rod and has a first end and a second end. The first end of each connection member 21 is rigidly or monolithically connected to the first modal displacement region R1 of one of the respective paired neighboring blades 5 and the second end of each connection member 21 is rigidly or monolithically connected to the second modal displacement region R2 of the other of said paired neighboring blades 5, which together define a respective flow vane 13, such that the connection member 21 extends through the flow vane 13.

As shown in FIG. 2, the first ends of the connection members 21 are arranged along a first circumference centered on the rotation axis A-A of the impeller 1 and laying on a plane orthogonal to the rotation axis A-A, and shown at C1. The second ends of connection members 21 are arranged along a second circumference centered on the rotation axis A-A of the impeller 1 and laying on a plane C2 orthogonal to said rotation axis A-A.

The first end of each connection member 21 can be rigidly or monolithically connected to the suction side or to the pressure side of the respective first blade, while the second end of the connection member 21 is connected to the pressure side or to the suction side of the second blade, depending upon the shape of the blades. As shown in the exemplary embodiment of FIGS. 1 and 2, the first end of the connection member 21 is usually rigidly or monolithically connected to a concave portion of the side surface of the first blade 5, in the first modal displacement region R1, near the first blade edge 9 and the blade tip 5T; while the second end of the connection member 21 is rigidly or monolithically connected to a usually convex portion of the side surface of the second blade 5.

In some embodiments, the first end of each connection member 21 is attached to the respective first blade 5 at some distance from the first blade edge 9 and from the blade tip 5T, to obtain a better stiffening effect. As a matter of fact, by applying the connection member 21 to the blade 5, the oscillating mass of the blade 5 is augmented. By arranging the attachment point of the additional mass represented by the connection member 21 at some distance from the blade tip 5T, the negative effect of the mass increase on the modal displacement is reduced.

The second end of the connection member 21 can be attached at a distance from the blade tip 5T of the respective neighboring blade 5. The distance between the blade tip 5T and the second end of the connection member 21 can be larger than the distance between the blade tip 5T and the first end of the connection member 21. Since the first modal displacement region R1 is nearer to the first blade edge 9 than the second modal displacement region R2, the distance between the first end of the connection member 21 and the first blade edge 9 of the respective blade 5 is smaller than the distance between the second end of the connection member 21 and the blade edge 9 of the respective blade 5.

The connection provided by the connection member 21 between the first modal displacement region R1 and the second modal displacement region R2 increases the stiffness of the blades and thus of the entire impeller, such that dangerous resonance frequencies are moved away from the impeller operative frequency.

In embodiments, the connection members 21 have an aerodynamic profile, with a leading edge and a trailing edge oriented approximately orthogonal to the lines of flow of the fluid processed through the flow vanes 13 of the impeller 1.

Figure 4:
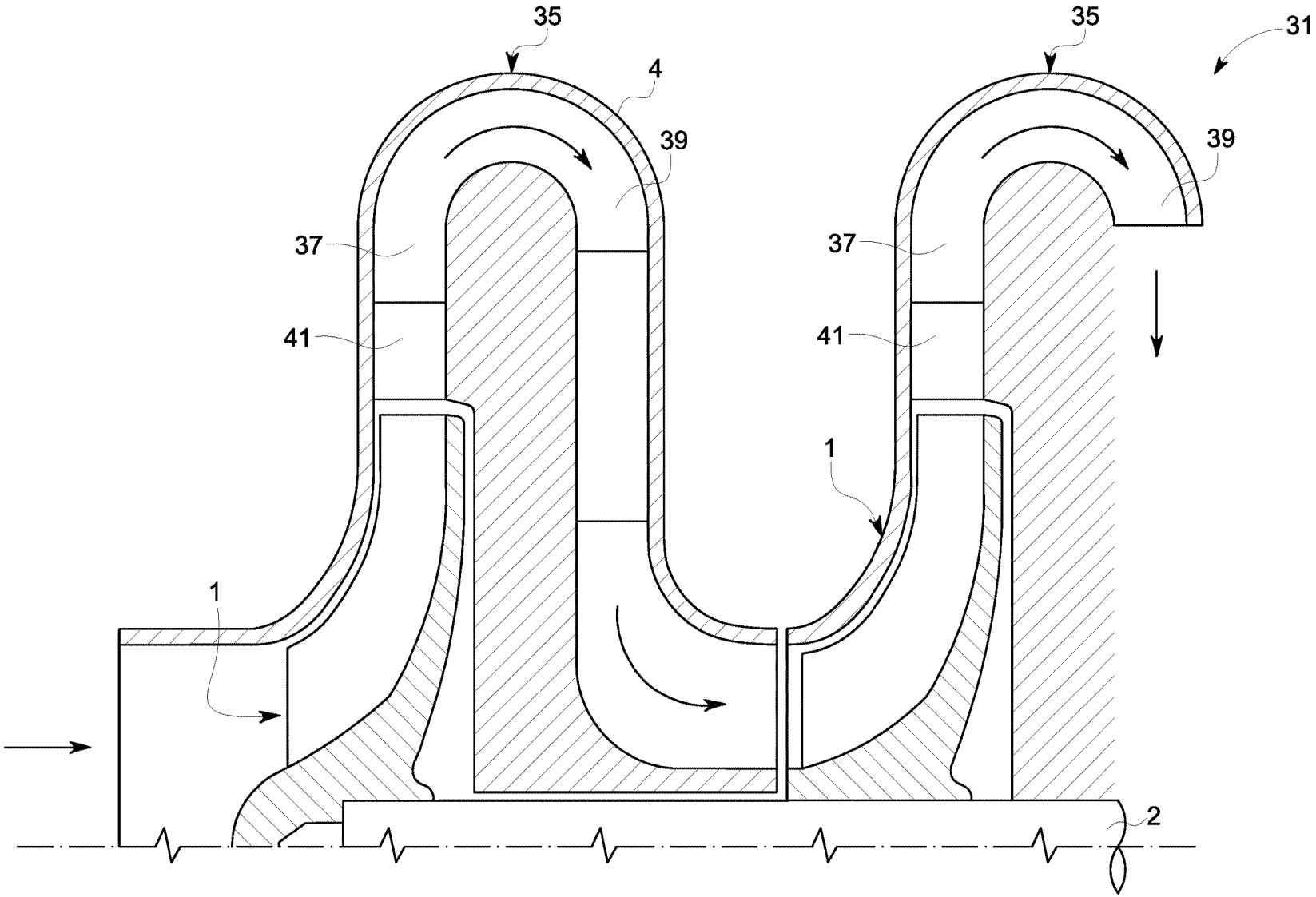
FIG. 4 illustrates a partial sectional view of an exemplary multi-stage radial compressor using unshrouded impellers according to the present disclosure.

Stiffened impellers as shown in FIGS. 1 to 3 can be used in single stage or multi-stage centrifugal compressors. FIG. 4 illustrates, by way of example only, a sectional view of a portion of a multi-stage centrifugal compressor 31, comprising at least two compressor stages 33, 35. Each compressor stage comprises an impeller 1 mounted for rotation on a shaft 2 in a casing 4. Each compressor stage 33, 35 further comprise a diffuser 37 and a return channel 39. The diffuser 37 can be a bladed diffuser comprised of stationary blades 41. Return channel blades are shown at 43. One or both the impellers 1 of the compressor 31 can be provided with connection members 21 as described above and illustrated in FIGS. 1 and 2. The multistage compressor 31 can include more than just two stages. Only one, some or all the impellers can be stiffened by providing connection members 21 therein, while other impellers can be unshrouded impellers or shrouded impellers according to the current art.

Stiffened impellers 1 as disclosed herein can also be used in other kinds of radial turbomachines, such as in single-stage or multi-stage radial turbines, single-stage or multi-stage radial turbo-expanders, single-stage or multi-stage centrifugal pumps, as well as mixed-flow turbomachines, such as mixed-flow pumps, compressors or turbines.

Figure 5:
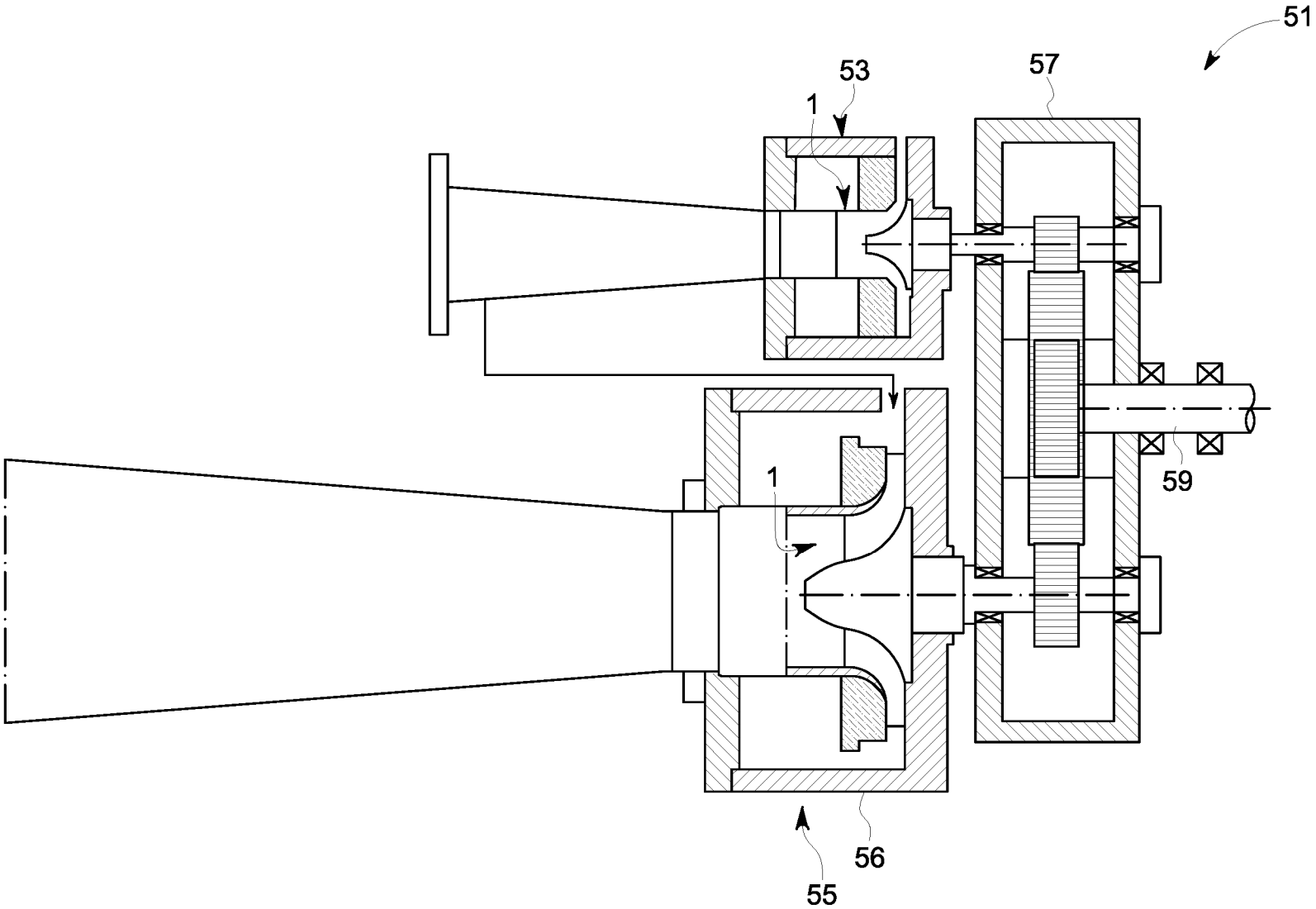
FIG. 5 illustrates a partial sectional view of an exemplary turboexpander using unshrouded impellers according to the present disclosure.

By way of example FIG. 5 illustrates a multi-stage integrally geared turboexpander 51, comprising two turbo-expander stages 53 and 55 housed in a casing 56. Each turboexpander stage 53, 55 comprises an impeller 1 mounted for rotation in the casing 56. One or both impellers 1 can be designed as shown in FIGS. 1 and 2 for improved stiffness. The turboexpander 51 can include more than just two stages as shown in FIG. 5. The shafts whereon the impellers 1 are mounted can be drivingly connected to a gearbox 57, wherefrom an output shaft 59 extends. Power generated by the turboexpander is made available on the output shaft 59, which can be drivingly connected to a load (not shown).

In other embodiments, the turboexpander can include only one stage. If more than one stage is provided, one, some or all stages can include stiffened impellers 1 as described above. It is not mandatory that all impellers be designed with connection members 21 for stiffening purposes. One or some of the impellers can be unshrouded and un-stiffened impellers of the current art, or else shrouded impellers. according to the current art.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

The invention claimed is:

1. An unshrouded turbomachine impeller comprising:

a rotation axis;

a hub;

a plurality of sequentially arranged blades, each blade extending from a blade root at the hub to a blade tip and comprising a first blade edge, a second blade edge, a first side surface defining a pressure side of the respective blade and a second side surface opposite the first side surface defining a suction side of the respective blade, the first blade edge and the second blade edge extending from the hub to the blade tip, and the pressure side and the suction side extending from the first blade edge to the second blade edge and from the blade root to the blade tip;

a flow vane arranged between each pair of neighboring blades; and a plurality of connection members, each connection member spanning across and extending through a flow vane formed between a respective pair of neighboring blades and connecting a first modal displacement region at a certain frequency of a first blade of said pair of neighboring blades to a second modal displacement region at said frequency of a second blade of said pair of neighboring blades, wherein each connection member extends from the first side surface of the first blade of said pair of neighboring blades to the second side surface of the second blade of said pair of neighboring blades, or vice versa, and does not perforate either of the first and second side surfaces.

2. The turbomachine impeller of claim 1, wherein the first blade edge is located at a first radial distance from the rotation axis and the second blade edge is located at a second radial distance from the rotation axis the first radial distance being smaller than the second radial distance.

3. The turbomachine impeller of claim 1, wherein the first modal displacement region is located proximate the blade tip and proximate the first blade edge, and the second modal displacement region is located in an intermediate position between the first blade edge and the second blade edge.

4. The turbomachine impeller of claim 1, wherein each connection member is rigidly or monolithically connected to the first modal displacement region of a first one of said pair of neighboring blades at a first distance from the respective blade tip, and to the second modal displacement region of the second one of said pair of neighboring blades at a second distance from the respective blade tip, the first distance being smaller than the second distance.

5. The turbomachine impeller of claim 1, wherein each connection member is constrained to the first modal displacement region of a first one of said pair of neighboring blades at a first distance from the respective first blade edge thereof, and to the second modal displacement region of the second one of said pair of neighboring blades at a second distance from the respective first blade edge thereof, the first distance being smaller than the second distance.

6. The turbomachine impeller of claim 3, wherein the first ends of the connection members are positioned along a first circumference centered on the rotation axis and second ends of connection members are positioned along a second circumference centered on the rotation axis.

7. The turbomachine impeller of claim 1, wherein the connection members have an aerodynamic profile.

8. The turbomachine impeller of claim 1, wherein each connection member extends approximately orthogonal to lines of flow in the respective flow vane.

9. A turbomachine comprising a casing and at least one turbomachine impeller according to claim 1, mounted for rotation in the casing.

10. A method for producing a turbomachine impeller according to claim 1, the method comprising the steps of:

manufacturing an impeller body comprised of a hub and a plurality of sequentially arranged blades, extending from a front surface of the hub to respective blade tips, and defining a plurality of flow vanes between pairs of neighboring blades; and arranging in each flow vane a connection member having a first end and a second end, the first end rigidly or monolithically connected to a first side surface of one of a pair of neighboring blades, and the second end rigidly or monolithically connected to a second side surface one of said pair of neighboring blades, the first and second side surfaces forming the pressure and suction sides of respective blades, wherein the connection member does not perforate either of the first and second side surfaces of the respective blades it is connected to.

11. A method for manufacturing a turbomachine impeller of claim 1, comprising the step of machining the hub, the blades and the connection members by full milling from a single piece.

* * * * *